US008406674B2

(12) United States Patent
Shin et al.

(10) Patent No.: US 8,406,674 B2
(45) Date of Patent: Mar. 26, 2013

(54) IMAGE FORMING APPARATUS AND METHOD OF CONTROLLING THE SAME

(75) Inventors: Joong-gwang Shin, Seongnam-si (KR); Sung-min Park, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 1088 days.

(21) Appl. No.: 11/869,247

(22) Filed: Oct. 9, 2007

(65) Prior Publication Data

US 2008/0175634 A1 Jul. 24, 2008

(30) Foreign Application Priority Data

Jan. 19, 2007 (KR) ..... 10-2007-0006257

(51) Int. Cl.
*G03G 21/00* (2006.01)

(52) U.S. Cl. ..... 399/346; 399/351; 430/119.82; 430/119.83; 430/119.84

(58) Field of Classification Search ..... 399/346, 399/51, 71, 351; 430/119.82–119.84
See application file for complete search history.

(56) References Cited

U.S. PATENT DOCUMENTS

| | | | | |
|---|---|---|---|---|
| 5,107,285 | A * | 4/1992 | Hamada et al. | 347/130 |
| 5,463,455 | A * | 10/1995 | Pozniakas et al. | 399/350 |
| 5,604,524 | A * | 2/1997 | Itoh et al. | 347/112 |
| 6,014,530 | A * | 1/2000 | Tsunemi | 399/53 |
| 6,026,255 | A * | 2/2000 | Kizaki et al. | 399/43 |
| 6,032,006 | A * | 2/2000 | Yanagida | 399/101 |
| 6,072,512 | A * | 6/2000 | Fukasawa | 347/131 |
| 6,434,348 | B1 * | 8/2002 | Tomizawa | 399/66 |
| 6,542,713 | B2 * | 4/2003 | Jones et al. | 399/343 |
| 7,317,890 | B2 * | 1/2008 | Kyung | 399/299 |
| 7,720,400 | B2 * | 5/2010 | Taguchi et al. | 399/49 |
| 7,937,011 | B2 * | 5/2011 | Yamamoto et al. | 399/71 |
| 8,103,206 | B2 * | 1/2012 | Gross et al. | 399/346 |
| 2004/0047642 | A1 * | 3/2004 | Kosuge | 399/53 |
| 2004/0147664 | A1 * | 7/2004 | Lee et al. | 524/507 |
| 2005/0100361 | A1 * | 5/2005 | Tanaka et al. | 399/101 |
| 2005/0100369 | A1 * | 5/2005 | Park et al. | 399/302 |
| 2005/0220478 | A1 * | 10/2005 | Ai et al. | 399/101 |
| 2006/0088351 | A1 * | 4/2006 | Thompson et al. | 399/350 |
| 2006/0093409 | A1 * | 5/2006 | Kyung | 399/299 |
| 2006/0110173 | A1 * | 5/2006 | Yamamoto et al. | 399/44 |
| 2006/0291885 | A1 * | 12/2006 | Radulski et al. | 399/71 |
| 2007/0014605 | A1 * | 1/2007 | Facci et al. | 399/346 |
| 2007/0031746 | A1 * | 2/2007 | Toshine et al. | 430/58.7 |
| 2007/0116483 | A1 * | 5/2007 | Kobayashi et al. | 399/49 |

(Continued)

FOREIGN PATENT DOCUMENTS

| | | |
|---|---|---|
| JP | 10-186255 | 7/1998 |
| JP | 2002-99128 | 4/2002 |

(Continued)

*Primary Examiner* — David Gray
*Assistant Examiner* — Geoffrey Evans
(74) *Attorney, Agent, or Firm* — Stanzione & Kim, LLP

(57) ABSTRACT

An image forming apparatus includes a photosensitive medium to be charged with a predetermined potential by a charging member, an exposing unit to expose the photosensitive medium to vary a charging level of the photosensitive medium, a developing unit to form an image for one or more colors on the photosensitive medium, a transfer medium to transfer the image from the photosensitive medium, a cleaning unit to clean the transfer medium, and a controller to control an optical power of the exposing unit to be lower than that during forming of the image when a toner band is applied to lubricate at least one of the cleaning unit and the transfer medium.

13 Claims, 4 Drawing Sheets

U.S. PATENT DOCUMENTS

| | | | | |
|---|---|---|---|---|
| 2007/0201897 | A1* | 8/2007 | Maeda et al. | 399/101 |
| 2008/0013986 | A1* | 1/2008 | Kosuge | 399/159 |
| 2011/0222885 | A1* | 9/2011 | Yamaki et al. | 399/66 |
| 2011/0268463 | A1* | 11/2011 | Kimura et al. | 399/53 |

FOREIGN PATENT DOCUMENTS

| | | |
|---|---|---|
| KR | 2003-95194 | 12/2003 |
| KR | 2005-12021 | 1/2005 |

* cited by examiner

IMAGE FORMING APPARATUS AND METHOD OF CONTROLLING THE SAME

CROSS-REFERENCE TO RELATED APPLICATIONS

This application claims priority under 35 U.S.C. §119 (a) from Korean Patent Application No. 10-2007-0006257, filed on Jan. 19, 2007, in the Korean Intellectual Property Office, the disclosure of which is incorporated herein by reference in its entirety.

BACKGROUND OF THE INVENTION

1. Field of the Invention

The present general inventive concept relates to an image forming apparatus and a method of controlling the same. More particularly, the present general inventive concept relates to an image forming apparatus and a method of controlling the same, which print a color image by superimposing the color image on a transfer medium and transferring the superimposed color image to a printing medium.

2. Description of the Related Art

An electro-photographic image forming device generally includes a photosensitive medium, for example, a photosensitive drum, for developing an image, and a traveling belt, e.g., an intermediate transfer medium, for transferring the image developed on the photosensitive drum to a printing paper. A developing unit for each color is arranged on one side of the photosensitive drum so as to develop images for four colors, i.e., yellow, magenta, cyan, and black, on the photosensitive drum in sequence.

As one example of the intermediate transfer medium, an intermediate transfer belt is driven in contact with the photosensitive drum. A color image developed for each color is superimposed on the intermediate transfer belt from the photosensitive drum to obtain an image for a desired color, and then the final color image formed by the superimposition is transferred to a recording medium which is moved in contact with the intermediate transfer belt.

The intermediate transfer belt is driven in one direction, with it being supported by a plurality of support rollers comprising a drive roller and a tension roller, to serve a function of transferring the superimposed color image to the recording medium.

In the above construction, a cleaning blade is positioned in contact with the intermediate transfer belt so as to clean toner remaining on the intermediate transfer belt.

If the intermediate transfer belt is driven at a warming up or printing operation in the state that the cleaning blade is in contact with the intermediate transfer belt, the cleaning blade may be turned over due to the friction therebetween. In order to prevent the turn-over of the cleaning blade, a toner band to prevent the turn-over of the cleaning blade is usually provided on the intermediate transfer belt at a predetermined width.

In particular, during the printing operation, the toner band is applied in an interval between the color images (whole or specified period) to prevent the turn-over of the cleaning blade.

Since the toner band applied at the warming up operation secures a time needed to sufficiently stabilize a potential of the photosensitive drum prior to exposure of an exposing unit for image forming, potential variation of the photosensitive medium is reduced and/or eliminated. The toner band applied at the interval between the color images does not secure a time required to sufficiently stabilize the potential of the photosensitive drum, however, which impacts a next image by causing an exposing potential variation of the photosensitive drum. Thus, there is a problem that a so-called dark band is formed on the image.

Referring to FIG. 1, a yellow image is firstly formed in a period Y, and a magenta image is formed in a period M. Accordingly, the toner band is applied at the interval between the yellow and magenta image forming periods Y and M. In order to apply the toner band, the photosensitive drum is exposed with a predetermined potential in a desired period I between the yellow and magenta image forming periods Y and M. A potential variation is produced on the photosensitive drum between the exposed portion and a predetermined portion A of the next magenta image forming period M. More specifically, the exposing potential is lower in the toner band forming period I, compared with other periods. As a result, since an amount of the toner is varied (i.e., it is increased), a horizontal dark line or dark band occurs on the image.

Also, the image forming device is provided with a cleaning unit for cleaning the photosensitive medium, in addition to the cleaning unit for cleaning the transfer medium such as the intermediate transfer medium. Accordingly, a toner band is applied on the photosensitive medium to provide lubrication between the cleaning unit for the photosensitive medium and the photosensitive medium. Accordingly, since the exposing potential is also varied on the photosensitive medium, the dark line described above occurs on the image.

SUMMARY OF THE INVENTION

The present general inventive concept provides an image forming apparatus capable of preventing a turn-over of a cleaning unit while minimizing an effect on an image, and a method of controlling the same.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an image forming apparatus, which includes a photosensitive medium to be charged with a predetermined potential by a charging member, an exposing unit to expose the photosensitive medium to vary a charging level of the photosensitive medium, a developing unit to form an image for one or more colors on the photosensitive medium, a transfer medium to transfer the image from the photosensitive medium, a cleaning unit to clean the transfer medium, and a controller to control an optical power of the exposing unit to be lower than that during forming of the image when a toner band is applied to lubricate at least one of the cleaning unit and the transfer medium.

The controller may control the optical power of the exposing unit within a range of 0.09 mW to 0.13 mW when the toner band to lubricant at least one of the cleaning unit and the transfer medium is applied. Also, the controller controls the optical power of the exposing unit so that a density of the toner band is within a range of 60% to 80% of a saturated density of a toner.

The foregoing and/or other aspects and utilities of the present general inventive concept may also be achieved by providing a method of controlling an image forming apparatus, which includes forming a first color image on a photosensitive medium, and transferring the image to a transfer medium, forming a second color image on the photosensitive medium, and transferring the image to the transfer medium to superimpose the second color image on the first color image, and applying a toner band to lubricant a cleaning unit which cleans the transfer medium at an interval between the forming the first color image and the forming the second color image operations, wherein the toner band is applied with a density lower than a density of the first and second color images.

The applying the toner band may include, after the first color image is formed, irradiating light to the photosensitive medium to expose a portion of the photosensitive medium, applying a toner to the exposed portion to form the toner band, and transferring the toner band to the transfer medium.

At the operation of irradiating the light, the exposing unit may be driven by an optical power lower than an exposing potential for the first and second color images.

At the operation of irradiating the light, the optical power of the exposing unit may be controlled to be within the range of 0.09 mW to 0.13 mW.

At the applying operation, a plurality of toner bands may be formed at the interval between the forming the first color and the forming the second color operations.

The foregoing and/or other aspects and utilities of the present general inventive concept may also be achieved by providing an image forming apparatus, which includes a photosensitive medium to be charged with a predetermined potential by a charging member, an exposing unit to expose the photosensitive medium to vary a charging level of the photosensitive medium, a developing unit to form an image for one or more colors on the photosensitive medium, a cleaning unit to clean the photosensitive medium, and a controller to control an optical power of the exposing unit to be lower than that during forming of the image forming if a toner band is applied to lubricate at least one of the cleaning unit and the photosensitive medium.

The foregoing and/or other aspects and utilities of the present general inventive concept may also be achieved by providing an image forming device, which includes a photosensitive medium on the surface of which a visible image is formed by a toner, a potential applicator to apply a potential to the photosensitive medium, a developing unit to supply the toner to the photosensitive medium to form an image, a cleaning unit to clean the photosensitive medium, and a controller to control the potential applied by the potential applicator so that a density of the toner is lower than that during forming of the image if a toner band is applied to lubricate at least one of the cleaning unit and the photosensitive medium.

The foregoing and/or other aspects and utilities of the general inventive concept may also be achieved by providing an image forming apparatus including a cleaning unit to clean a transfer medium and a controller to determine whether a toner band to lubricate at least one of the cleaning unit and the transfer medium is applied and, if so, to control a level of optical power of an exposing unit to be lower than a level of the optical power of the exposing unit during forming of an image.

The foregoing and/or other aspects and utilities of the general inventive concept may also be achieved by providing a method of operating an image forming apparatus, the method including cleaning a transfer medium, and determining whether a toner band to lubricate at least one of a cleaning unit and the transfer medium is applied and, if so, controlling a level of optical power of an exposing unit to be lower than a level of the optical power of the exposing unit during forming of an image.

The foregoing and/or other aspects and utilities of the general inventive concept may also be achieved by providing an image forming apparatus, including a transfer medium, a cleaning unit having a cleaning position to clean the transfer medium, a toner band generator to generate a toner band to lubricate at least one of the cleaning unit and the transfer medium to prevent the cleaning unit from unintentionally being moved from the cleaning position due to friction between the cleaning unit and the transfer medium.

The foregoing and/or other aspects and utilities of the general inventive concept may also be achieved by providing a method of operating an image forming apparatus, the method including applying a cleaning unit to clean a transfer medium and forming a toner band having a predetermined width and a length corresponding to a width of the transfer medium during a warm-up operation of the image forming apparatus to lubricate at least one of the cleaning unit and transfer medium.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
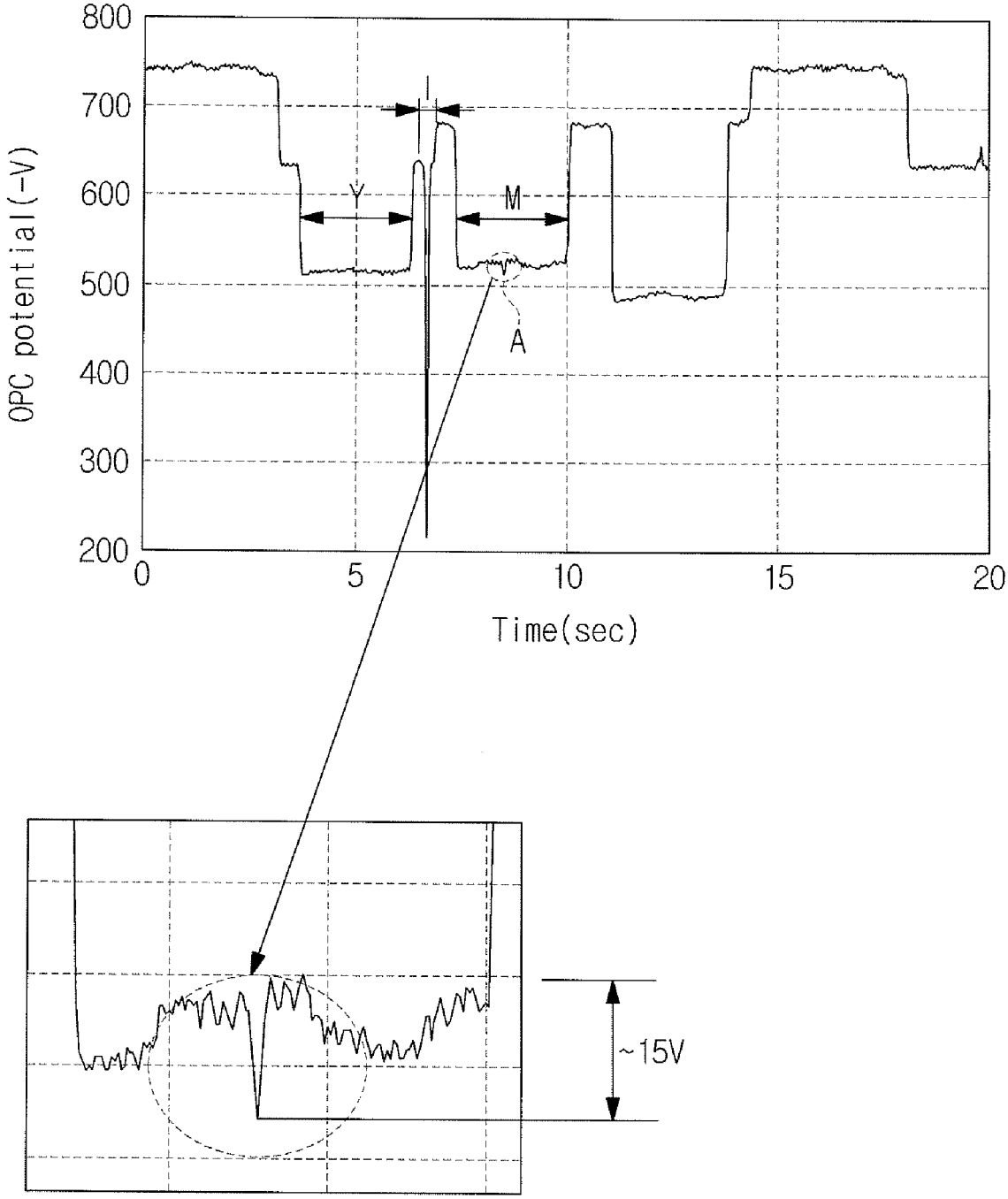
FIG. 1 (RELATED ART)
FIG. 1 is a graph illustrating an exposing potential of a photosensitive medium in a conventional laser scanning unit.

Reference will now be made in detail to embodiments of the present general inventive concept, examples of which are illustrated in the accompanying drawings, wherein like reference numerals refer to the like elements throughout. The embodiments are described below in order to illustrate the present general inventive concept by referring to the figures.

Figure 2:
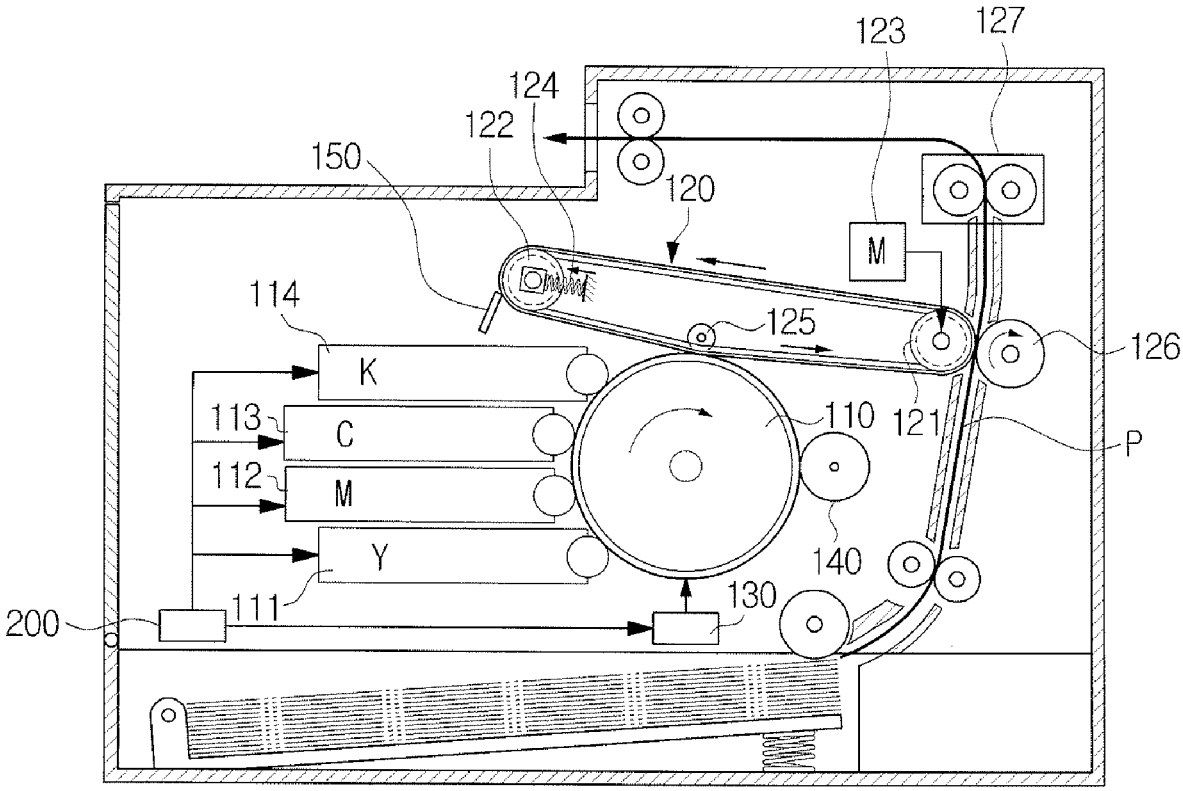
FIG. 2 is a diagram view schematically illustrating a construction of an image forming apparatus according to an exemplary embodiment of the present general inventive concept.

FIG. 2 is a diagram view schematically illustrating a construction of an image forming apparatus according to an exemplary embodiment of the present general inventive concept. Referring to FIG. 2, the image forming apparatus includes a photosensitive medium 110, developing units 111, 112, 113, and 114 to form an image on the photosensitive medium 110 for each color, a transfer medium 120 to transfer the image from the photosensitive medium 110, an exposing unit 130 irradiating laser light onto a surface of the photosensitive medium 110 to form an electrostatic latent image corresponding to the desired image, a charging member 140 to charge the photosensitive medium 110, a cleaning unit 150 to clean a surface of the transfer medium 120, and a controller 200 to control operations of the exposing unit 130 and the developing units 111, 112, 113, and 114.

The photosensitive medium 110 is in the form of a drum, and is installed so that it is rotated in only one direction.

The developing units 111, 112, 113, and 114 may be provided as a unitary or plural structure. More specifically, an image forming apparatus to provide color development may include a plurality of the developing units 111, 112, 113, and 114 disposed around the photosensitive medium 110 so as to form images for yellow, magenta, cyan, and black colors on the photosensitive medium 110. Each of the developing units 111, 112, 113, and 114, for example, is provided with a developing roller, and is accommodated with a developer such as a toner. Also, each of the developing units 111, 112, 113, and 114 are arranged so that they can access the photosensitive medium 110. For example, when forming the image for the yellow color, the developing unit 111 accesses the photosensitive medium 110, while other developing units 112, 113, and 114 are spaced apart from the photosensitive medium 110. The transfer medium 120 includes an intermediate transfer belt supported by a plurality of support rollers 121 and 122, in which the intermediate transfer belt is driven in one direction, being in contact with the photosensitive medium 110. One support roller 121 is rotated by a drive motor 123, while the other support roller 122 is resiliently supported by a biasing member 124. Consequently, since the support roller 122 is rotated, being biased by the biasing member 124, the transfer medium 120 is maintained in a proper tension.

The transfer medium 120 comes in contact with the photosensitive medium 110 by a primary transfer roller 125. The image for each color formed on the photosensitive medium 110 by the developing units 111, 112, 113, and 114 is superimposed on the transfer medium 120 by the primary transfer roller 125 to obtain a desired full color image.

The transfer medium 120 is provided with a secondary transfer roller 126 that can access the transfer medium. While a printing medium P passes through a gap between the transfer medium 120 and the secondary transfer roller 126, the full color image superimposed on the transfer medium 120 is transferred to the printing medium P.

The printing medium P transferred with the full color image is fixed at a high temperature and a high pressure through a fixing unit 127, and then is outwardly discharged.

The exposing unit 130 irradiates laser light onto the surface of the photosensitive medium 110 to form an electrostatic latent image corresponding to the desired image on the surface of the photosensitive medium 110. The exposing unit 130 is controlled by the controller 200, and the optical power irradiated by the exposing unit 130 is also controlled by the controller 200. The exposing unit 130 may be a laser scanning unit or LED.

The charging member 140 includes a charging roller to rotate in contact with the photosensitive medium 110. The charging member 140 charges the surface of the photosensitive medium 110 with a predetermined potential. The photosensitive medium 110 charged at a predetermined level by the charging member 140 is partially exposed by the light irradiated by the exposing unit 130, so that it has a potential lower than that of surrounding portions to form an electrostatic latent image region. The charging member 140 may be controlled by the controller 200.

The cleaning unit 150 includes a cleaning blade positioned in contact with the surface of the transfer medium 120. The cleaning unit 150 cleans or eliminates the toner remaining on the transfer medium 120.

The controller 200 controls the exposing unit 130, the charging member 140, and the developing units 111, 112, 113, and 114. In particular, the controller 200 controls the exposing unit 130, the charging member 140, and the developing units 111, 112, 113, and 114 during the printing operation, so that the image for each color is sequentially formed and superimposed on the transfer medium 120.

The controller 200 controls the forming of a toner band to prevent the cleaning unit (e.g., blade) from being turned over due to friction between the transfer medium 120 and the cleaning unit 150. The toner band is formed prior to the printing operation, that is, during a warming up operation. The toner band is formed to have a predetermined width and length at an interval between image forming periods for each color during the printing operation. More specifically, the toner band has a length corresponding to a width of the transfer medium, and is formed in one or more sections to have a predetermined width in a traveling direction of the transfer medium 120.

Accordingly, the controller 200 controls the exposing unit 130 in such a manner that the photosensitive drum 110 is partially exposed so as to form the toner band. The exposing unit 130 is controlled to output optical power lower than optical power to form the image. In an embodiment of the present general inventive concept, the optical power of the exposing unit 130 to form a normal image is 0.3 mW to 0.35 mW, the optical power to form of the toner band is 0.09 mW to 0.13 mW.

Figure 3:
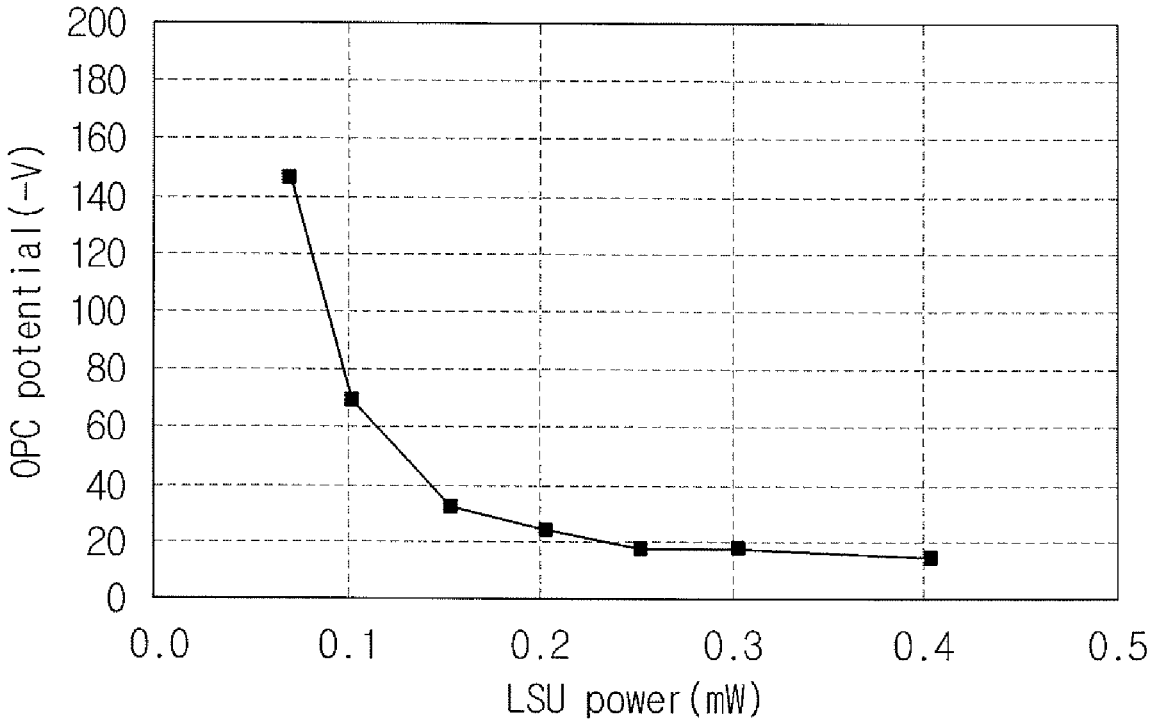
FIG. 3 is a graph illustrating an exposing potential variation resulted from an optical power variation of a laser scanning unit.

Referring to FIG. 3, in consideration of an exposing potential variation resulting from optical power of an exposing unit 130, if the optical power of the exposing unit 130 is controlled within the range, it is satisfied that a density of the toner at 60% to 80% of a saturated density may be accomplished. Therefore, it can secure an absolute amount of the toner as a lubricant of a cleaning unit 150, and can minimize the exposing potential variation.

Since a toner band to be used as the lubricant is formed while minimizing the exposing potential variation, it can reduce optical fatigue on a portion of the photosensitive medium which is exposed to form the toner band. As a result, it can suppress a possibility of an image error, such as black lines or black bands, in an image period, which is often found in the prior art.

Figure 4:
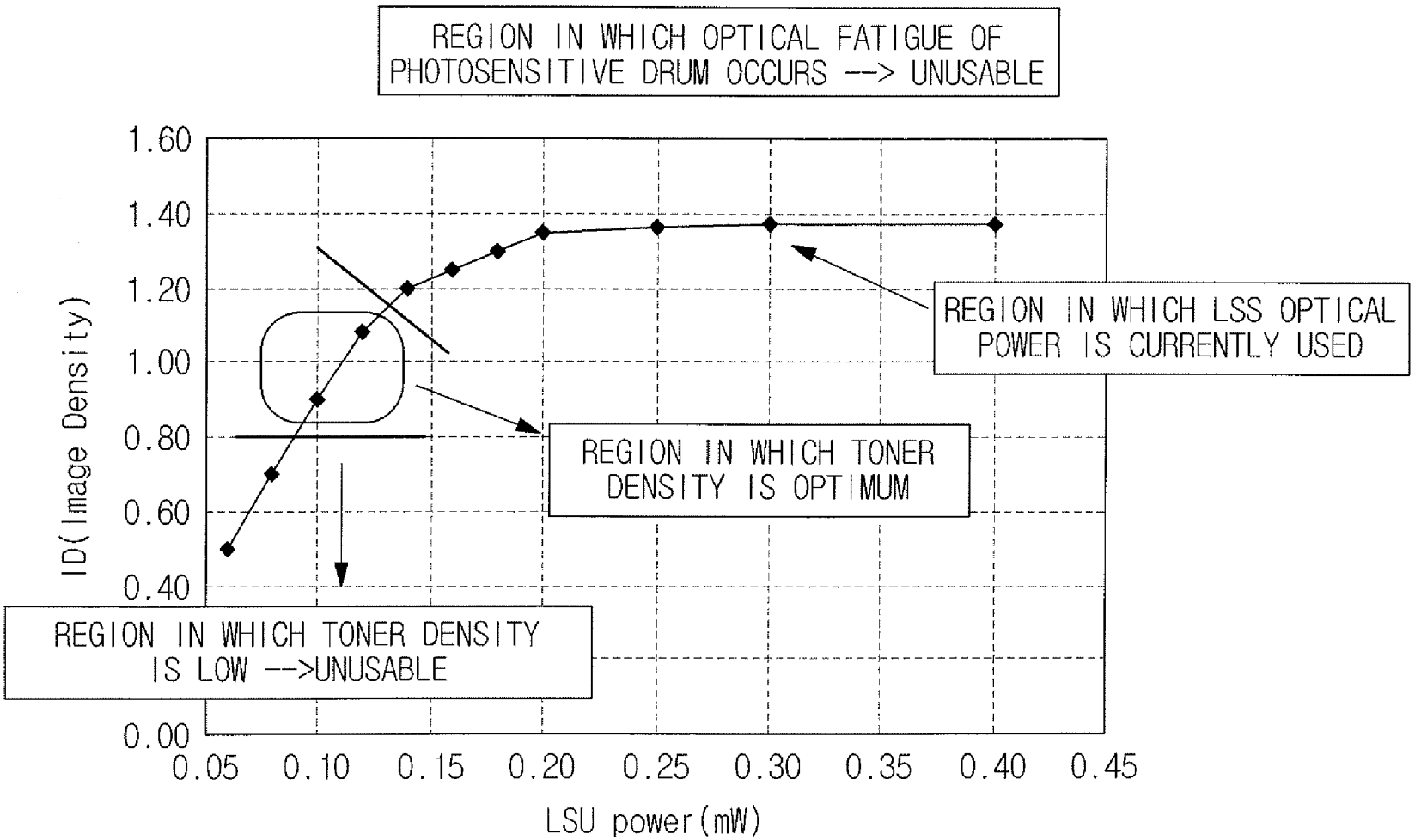
FIG. 4 is a graph illustrating an image density variation resulted from an optical power variation of a laser scanning unit.

FIG. 4 is a graph illustrating a setting of an optimum region to form a toner band. Referring to the graph of FIG. 4, since optical fatigue occurs in a photosensitive medium 110 when optical power of an exposing unit 130 (i.e., laser scanning unit) is above 0.15 mW, it is not beneficial to use the optical power of 0.15 mW or more. Also, since the toner density is very low when the optical power of the exposing unit 130 is below 0.08 mW, it is not beneficial to use the optical power of 0.08 mW or less since the absolute amount of toner is insufficient as the lubricant of the cleaning unit 150.

In consideration of the optical fatigue of the photosensitive medium 110 and the absolute density of toner, the optimum range of the optical power is 0.09 mW to 0.13 mW. That is, the optimum range is 60% to 80% of the saturated image density.

A method of controlling the image forming apparatus according to an embodiment of the present general inventive concept will now be described.

Firstly, if a power is input, the image forming apparatus warms up for an operation. When image data is input, the controller 200 controls each of the developing units 111, 112, 113, and 114 based on the input image data so as to form a color image. More specifically, in order to form a first color image, i.e., yellow color image, the charging member 140, the exposing unit 130, and the developing unit 111 are controlled to perform the charging, exposing, developing, and transferring process in sequence. The formed yellow color image is transferred to the transfer medium 120. Next, in order to form a second color image, i.e., magenta color image, the charging member 140, the exposing unit 130, and the developing unit 112 are controlled to perform the charging, exposing, developing, and transferring process in sequence. The formed magenta color image is transferred to and superimposed on the transfer medium 120.

The toner band to lubricate the cleaning unit 150 is applied at an interval between the first and second color images so as to prevent the cleaning unit 150 from being turned over. The controller 200 controls the exposing unit 130 and the developing unit 111 to perform the exposing and developing, thereby applying one or more toner bands having a predetermined width to a traveling direction of the transfer medium 120. Accordingly, the controller 200 controls the optical power of the exposing unit 130 to have about 0.09 mW to about 0.13 mW. Thus, an amount of the toner band sufficient to lubricate the cleaning unit 150 is applied. The portion exposed to apply the toner band hardly affects the potential of the portion exposed to form the next magenta color image. Accordingly, it can prevent the dark line or dark band from being formed on the second color image, i.e., the magenta color image.

Although not illustrated in the drawings, a cleaning unit (e.g., a blade) for the photosensitive medium may be provided on the upstream side of the charging member 140 as illustrated in FIG. 2. Accordingly, a toner band can be applied on the photosensitive medium 110 to lubricate a contact portion between the photosensitive medium 110 and a cleaning unit for the photosensitive medium 110. Accordingly, the exposing unit 200 is controlled to have the optical power lower than that of normal image forming, as described above with reference to FIGS. 2 to 4. Consequently, the photosensitive medium 110 can be effectively cleaned, and the forming of an inferior image can be prevented by applying the toner band to lubricate between the photosensitive medium 110 and the cleaning unit used to clean the photosensitive medium 110.

According to another embodiment of the present general inventive concept, a potential applicator to apply a potential to the photosensitive medium 110 may be provided, in addition to the exposing unit 130 and the charging member 140. More specifically, the photosensitive medium 110 can be adapted to be applied with the potential therein or by itself. The photosensitive medium 110 may be controlled by the controller 200 so that the photosensitive medium 110 applies the potential to a desired portion thereof by itself, without depending on the exposing unit 130 and the charging member 140. Therefore, the potential applicator described above including the photosensitive medium equipped with the potential applicator may be contained in the scope of the present general inventive concept.

As described above, the image forming apparatus and the method of controlling the same according to the exemplary embodiments of the present general inventive concept, when the toner band to prevent the turn-over of the cleaning unit (i.e., a blade) is applied, the optical power is maintained at a level lower than that of normal image forming, thereby minimizing the effect of the portion exposed to apply the toner band on the next color image and thus increasing the quality of the image.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

a photosensitive medium to be charged with a predetermined potential by a charging member;

an exposing unit to expose the photosensitive medium to vary a charging level of the photosensitive medium;

a developing unit to form an image for one or more colors on the photosensitive medium;

a transfer medium to transfer the image from the photosensitive medium;

a cleaning unit to clean the transfer medium; and a controller to control an optical power of the exposing unit to be lower than that during forming of the image and within a range of approximately 0.09 mW to 0.13 mW when a toner band is applied to lubricate at least one of the cleaning unit and the transfer medium, and to control the optical power of the exposing unit so that a density of the toner band is within a range of approximately 60% to 80% of a saturated density of a toner.

2. A method of controlling an image forming apparatus, comprising:

forming a first color image on a photosensitive medium, and transferring the image to a transfer medium;

forming a second color image on the photosensitive medium, and transferring the image to the transfer medium to superimpose the second color image on the first color image; and applying a toner band to lubricate a cleaning unit which cleans the transfer medium at an interval between the forming the first color image operation and the forming the second color image operation by controlling a level of optical power of an exposing unit to be within a range of approximately 0.09 mW to 0.13 mW and controlling the level of optical power of the exposing unit so that a density of the toner band is within a range of approximately 60% to 80% of a saturated density of a toner, wherein the toner band is applied in a density lower than a density of the first and second color images.

3. The method of claim 2, wherein the applying a toner band comprises:

after the first color image is formed, irradiating the photosensitive medium with light to expose a portion of the photosensitive medium;

applying a toner to the exposed portion to form the toner band; and transferring the toner band to the transfer medium.

4. The method of claim 3, wherein at the operation of irradiating the light, the exposing unit is driven by an optical power lower than an exposing potential for the first and second color images.

5. The method of claim 4, wherein at the operation of irradiating the light, the optical power of the exposing unit is controlled within the range of approximately 0.09 mW to 0.13 mW.

6. The method of claim 2, wherein at the applying operation, a plurality of toner bands are formed at the interval between the forming the first color image operation and the forming the second color image operation.

7. An image forming apparatus, comprising:

a photosensitive medium to be charged with a predetermined potential by a charging member;

an exposing unit to expose the photosensitive medium to vary a charging level of the photosensitive medium;

a developing unit to form an image for one or more colors on the photosensitive medium;

a cleaning unit to clean the photosensitive medium; and a controller to control an optical power of the exposing unit to be lower than that during forming of the image and within a range of approximately 0.09 mW to 0.13 mW when a toner band is applied to lubricate at least one of the cleaning unit and the photosensitive medium, and to control the optical power of the exposing unit so that a density of the toner band is within a range of approximately 60% to 80% of a saturated density of a toner.

8. An image forming apparatus, comprising:

a photosensitive medium formed with a visible image on a surface thereof by a toner;

a potential applicator to apply a potential to the photosensitive medium;

an exposing unit to expose the photosensitive medium to vary the potential of the photosensitive medium;

a developing unit to supply the toner to the photosensitive medium to form an image;

a cleaning unit to clean the photosensitive medium; and a controller to control an optical power of the exposing unit to be within a range of approximately 0.09 mW to 0.13 mW when a toner band is applied to lubricate at least one of the cleaning unit and the photosensitive medium, and to control the optical power of the exposing unit so that a density of the toner band is within a range of approximately 60% to 80% of a saturated density of the toner.

9. An image forming apparatus, comprising:

a cleaning unit to clean a transfer medium; and a controller to determine whether a toner band to lubricate at least one of the cleaning unit and the transfer medium is applied and, if so, to control a level of optical power of an exposing unit to be lower than a level of the optical power of the exposing unit during forming of an image and within a range of approximately 0.09 mW to 0.13 mW when the toner band to lubricate is applied, and to control the level of optical power of the exposing unit so that a density of the toner band is within a range of approximately 60% to 80% of a saturated density of a toner.

10. A method of operating an image forming apparatus, the method comprising:

cleaning a transfer medium; and determining whether a toner band to lubricate at least one of a cleaning unit and the transfer medium is applied and, if so, controlling a level of optical power of an exposing unit to be lower than a level of the optical power of the exposing unit during forming of an image and within a range of approximately 0.09 mW to 0.13 mW when the toner band to lubricate is applied, and controlling the level of optical power of the exposing unit so that a density of the toner band is within a range of approximately 60% to 80% of a saturated density of a toner.

11. An image forming apparatus, comprising:

a photosensitive medium;

an exposing unit to expose the photosensitive medium to vary a charging level of the photosensitive medium;

a transfer medium to receive a multi-color toner image from the photosensitive medium and transfer the multi-color image to a printing medium; and a controller to control an optical power of the exposing unit to be lower during forming of a toner band than when forming the multi-color image and within a range of approximately 0.09 mW to 0.13 mW when the toner band is formed, and to control the optical power of the exposing unit so that a density of the toner band is within a range of approximately 60% to 80% of a saturated density of a toner, with the toner band being formed at an interval between image forming periods of each of the multi-colors.

12. An image forming apparatus, comprising:

a photosensitive medium to be charged with a predetermined potential by a charging member;

an exposing unit to expose the photosensitive medium to vary a charging level of the photosensitive medium;

a developing unit to form an image for one or more colors on the photosensitive medium;

a transfer medium to transfer the image from the photosensitive medium;

a cleaning unit to clean the transfer medium; and a controller to control an optical power of the exposing unit to be 0.3 mW to 0.35 mW during forming of the image, and to control the optical power to be lower than that during forming of the image and within a range of approximately 0.09 mW to 0.13 mW when a toner band is applied to lubricate at least one of the cleaning unit and the transfer medium.

13. A method of controlling an image forming apparatus, comprising:

forming a first color image on a photosensitive medium, and transferring the image to a transfer medium;

forming a second color image on the photosensitive medium, and transferring the image to the transfer medium to superimpose the second color image on the first color image;

controlling a level of optical power of an exposing unit to be within a range of 0.3 mW to 0.35 mW when forming the first color image and the second color image; and applying a toner band to lubricate a cleaning unit which cleans the transfer medium at an interval between the forming the first color image operation and the forming the second color image operation by controlling the level of optical power of the exposing unit to be within a range of approximately 0.09 mW to 0.13 mW, wherein the toner band is applied in a density lower than a density of the first and second color images.

* * * * *